United States Patent [19]

Furukawa et al.

[11] Patent Number: 4,987,617

[45] Date of Patent: Jan. 29, 1991

[54] NOZZLE MECHANISM IN A SANITARY DEVICE

[75] Inventors: Hideki Furukawa, Toyota; Yuji Yamaguchi, Anjo, both of Japan

[73] Assignee: Aisin Seiki Kabushiki Kaisha, Kariya, Japan

[21] Appl. No.: 477,736

[22] Filed: Feb. 9, 1990

[30] Foreign Application Priority Data

Mar. 16, 1989 [JP] Japan ..... 1-64575
Mar. 16, 1989 [JP] Japan ..... 1-64576

[51] Int. Cl.[5] ..... A61H 35/00

[52] U.S. Cl. ..... 4/448; 4/420.1; 4/420.4; 4/443

[58] Field of Search ..... 4/443, 447, 448, 420.1–420.5

[56] References Cited

U.S. PATENT DOCUMENTS

| | | | |
|---|---|---|---|
| 1,935,201 | 11/1933 | Callejo | 4/448 |
| 2,872,687 | 2/1959 | Maurer | 4/420.2 |
| 4,094,018 | 6/1978 | Bemthin | 4/420.4 |
| 4,136,407 | 1/1979 | Maurer | 4/448 |
| 4,208,746 | 6/1980 | Minamoto et al. | 4/420.2 X |
| 4,551,868 | 11/1985 | Kawai et al. | 4/443 |
| 4,581,779 | 4/1986 | Matsui et al. | 4/420.2 |
| 4,628,548 | 12/1986 | Kurosawa et al. | 4/420.4 |
| 4,704,748 | 11/1987 | Takeda et al. | 4/420.1 |
| 4,841,582 | 6/1989 | Matsui et al. | 4/420.2 |

*Primary Examiner*—Henry K. Artis
*Attorney, Agent, or Firm*—Oblon, Spivak, McClelland, Maier & Neustadt

[57] ABSTRACT

A nozzle mechanism in a sanitary device has a first cylinder and a second cylinder each of which accommodates a pipe for injecting an amount of water. A single common driving device is positioned between the cylinders so as to selectively move the first cylinder or the second cylinder towards an interior of a toilet bowl.

4 Claims, 4 Drawing Sheets

G
F
H
J
I
K
θ
13
2b
12
11b
2a
11a
2c
11c
2a
31a
31
10
11
30
17
15
14
1
2

NOZZLE MECHANISM IN A SANITARY DEVICE

BACKGROUND OF THE INVENTION

Field of the Invention

The present invention relates to a nozzle mechanism in a sanitary device and in particular to a nozzle mechanism for operating two nozzle pipes.

Description of the Related Art

In a conventional nozzle mechanism of the type which is disclosed, for example, in Japanese Patent Laid-open Publication No. 60-25364 published without examination on Dec. 14, 1985, a pair of pipes are mounted on a common cylinder body and the cylinder body is moved by a stroke towards the interior of a toilet bowl before one of the pipes is extended to a position under the anus or the bidet portion (i.e., the vagina) to be washed and an amount of water is injected from the projected pipe.

However, this construction requires a motor with high-torque for moving the cylinder body, thereby requiring a construction which is large in mass or scale.

SUMMARY OF THE INVENTION

It is, therefore, a primary object of the present invention to provide a nozzle mechanism without the aforementioned drawback.

Another object of the present invention is to provide a nozzle mechanism which does not need a high torque motor in comparison with the conventional mechanism.

To achieve the the objects, the present invention comprises a plate fixedly mounted on the rear end portion of a toilet bowl; a first cylinder mounted on the plate so as to be movable towards the interior of the toilet bowl; a first pipe mounted in the first cylinder so as to be movable in the axial direction thereof; first driving means for moving the first plate; a second cylinder similar to the first cylinder; a second pipe similar to the first pipe; second driving means similar to the first driving means; and common driving means for selectively driving the first cylinder or the second cylinder. Since there are two cylinders and a single common driving means suffices for driving both cylinders, the size and weight of the unit is reduced.

BRIEF DESCRIPTION OF THE DRAWINGS

The above and other objects, features and advantages of the present invention will be become more apparent and more readily appreciated from the following detailed description of preferred exemplary embodiments of the present invention, taken in connection with the accompanying drawings, in which.

DETAILED DESCRIPTION OF THE PREFERRED EMBODIMENT

Figure 1:
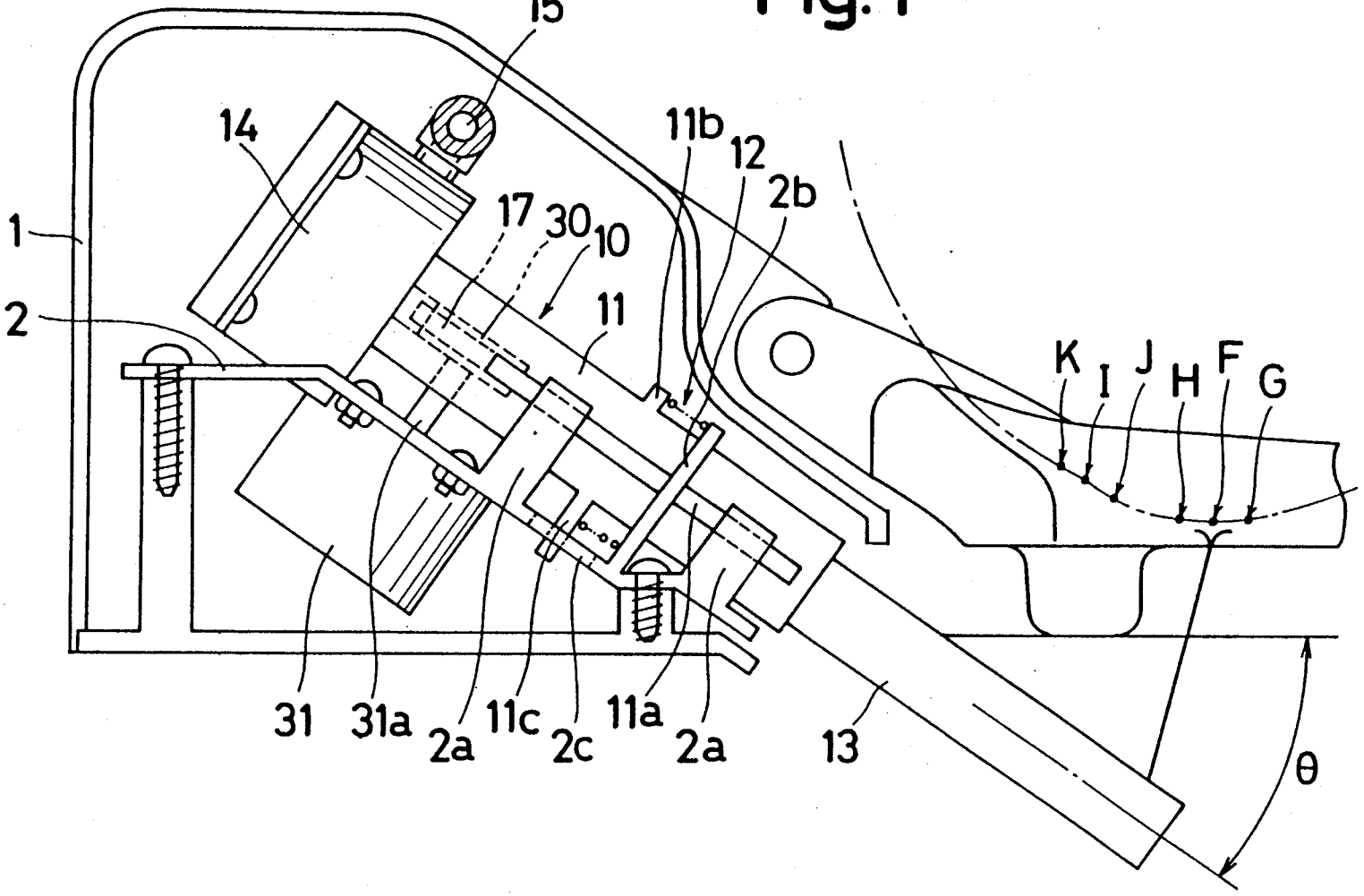
FIG. 1 is a side view of a nozzle mechanism according to one embodiment of the present invention.
Figure 2:
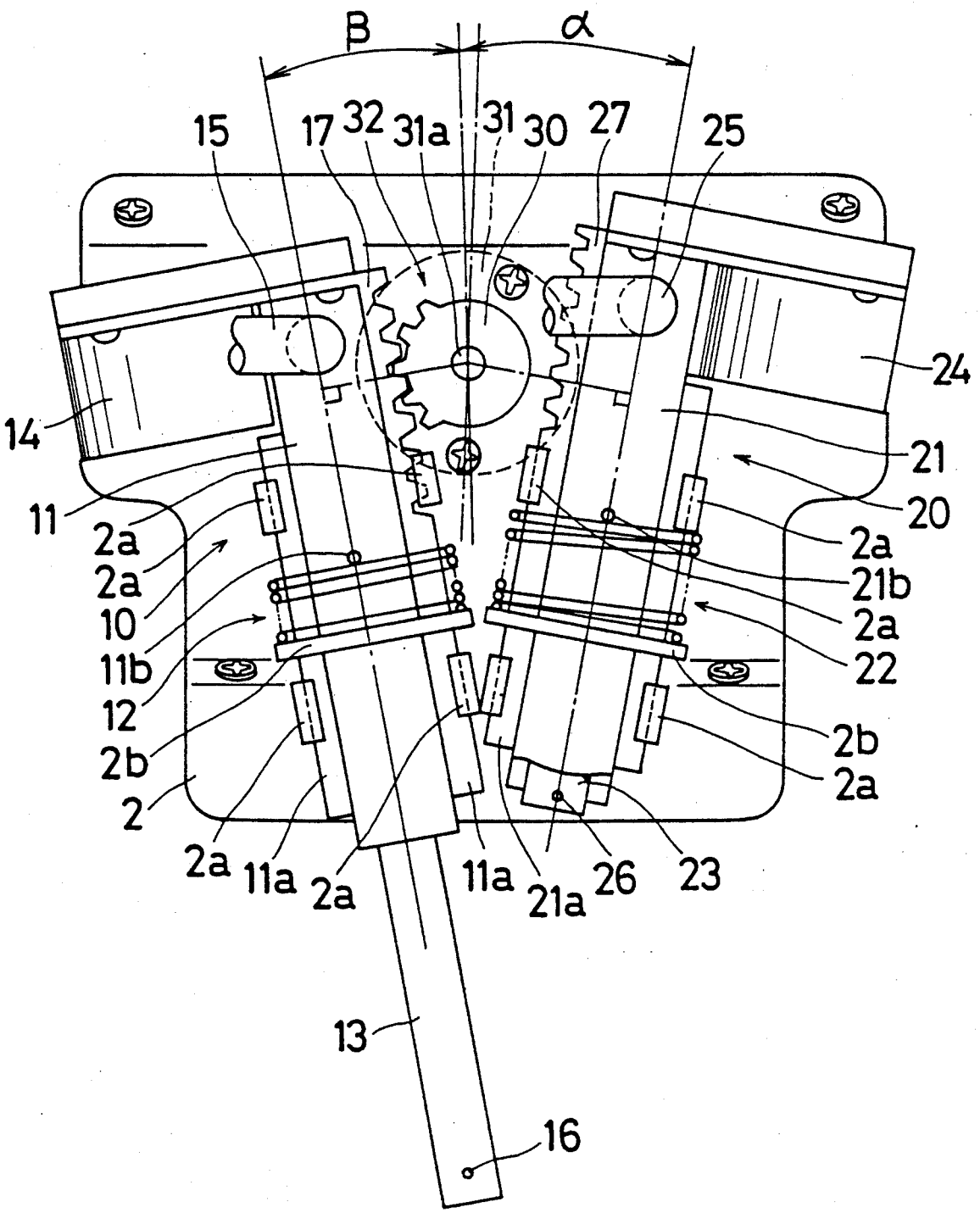
FIG. 2 is an upper plan view of the nozzle mechanism shown in FIG. 1.
Figure 3:
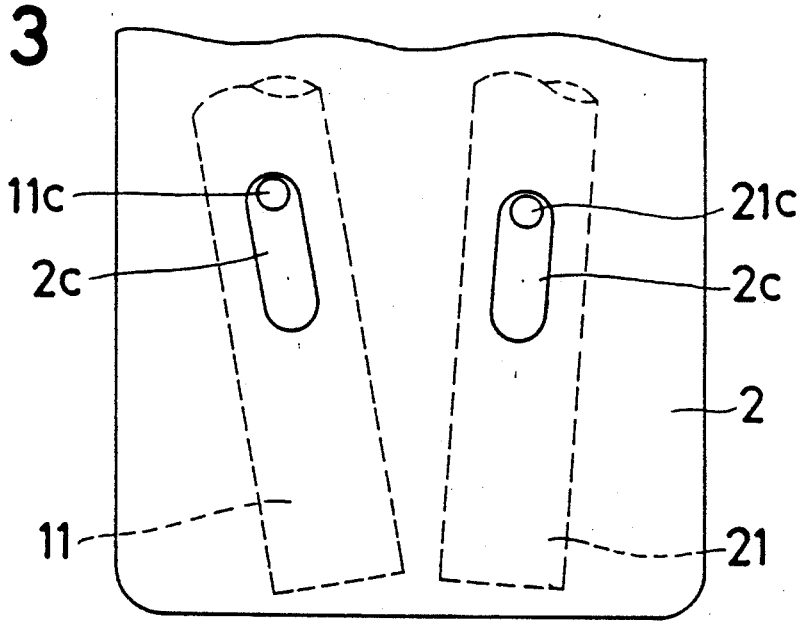
FIG. 3 is a lower partial plan view of the nozzle mechanism shown in FIG. 1.

Referring now to FIGS. 1 through 4, there is fixedly mounted a casing 1 on a rear end of a toilet bowl. Within the casing 1, there are arranged a first nozzle apparatus 10 for washing the bidet portion of the pubic portion of a female and a second nozzle apparatus 20 for washing the anus of an user. Each apparatus 10 (20) has a cylinder 11 (21) into which a pipe 13 (23) is axially slidably fitted. Both the cylinder 11 and the cylinder 21 form an angle $\theta$ relative to an upper surface of the bowl. Further, the cylinder 11 (21) makes an angle of $\beta$ ($\alpha$) relative to the axis of the bowl in the longitudinal (i.e. front to rear) direction.

On a plate 2 which is fixedly mounted within the casing 1, there is formed a supporting means including four grooved members 2*a*. A pair of axially oriented flanges 11*a* and 11*a* (21*a* and 21*a*) extend from opposite sides of each of the cylinders 11 (21). Each pair of flanges slides in two of the grooved members. Thus, the cylinder 11 (21) can be moved or slid, without rotation, in the axial direction towards the interior of the bowl. A projection 11*b* (21*b*) and a projection 11*c* (21*c*) are respectively formed on an upper portion and a lower portion of the cylinder 11 (21). The projection 11*b* (21*b*) and the projection 11*c* (21*c*) constitute a retainer. Between each retainer and one of two upright portions 2*b* formed integrally with the plate 2, there is interposed a spring 12 (22) so as to urge the cylinder 11 (21) in the rearward direction, i.e. away from the bowl interior. Each projection 11*c* (21*c*) is also in sliding engagement with a longitudinal slot 2*c* formed in the plate 2. Each slot 2*c* limits the movement of each cylinder 11 (21) between a fully advanced position A and a fully retracted position D (FIG. 4).

Within the cylinder 11 (21), there is axially slidably fitted the pipe 13 (23) which is driven by a motor 14 (24). The motor 14 (24) moves the pipe 13 (23) from the fully retracted position B to an operating position C and vice versa. An inlet port 15 (25) and a hole 16 (26) are formed on the cylinder 11 (21) and the pipe 13 (23) respectively. Cold water or warm water supplied to the inlet port 15 (25) will be ejected from the hole 16 (26) of the pipe 13 (23) towards the pubic or bidet portion ( the anus) of the user for the washing thereof when the pipe 13 (23) is set at its operating position C.

On a rear portion of the inner flange 11*a* (21*a*) of the cylinder 11 (21), there is formed a drive portion in the form of a rack 17 (27) having a plurality of gear teeth 17*a* (27*a*). Between the racks 17 and 27, there is disposed a common mechanical driving means including a driving member 30 having at its periphery a sector gear 32. The driving member 30 is fixedly mounted on a shaft 31*a* of a motor 31 which is disposed at a lower side of the plate 2.

Figure 4:
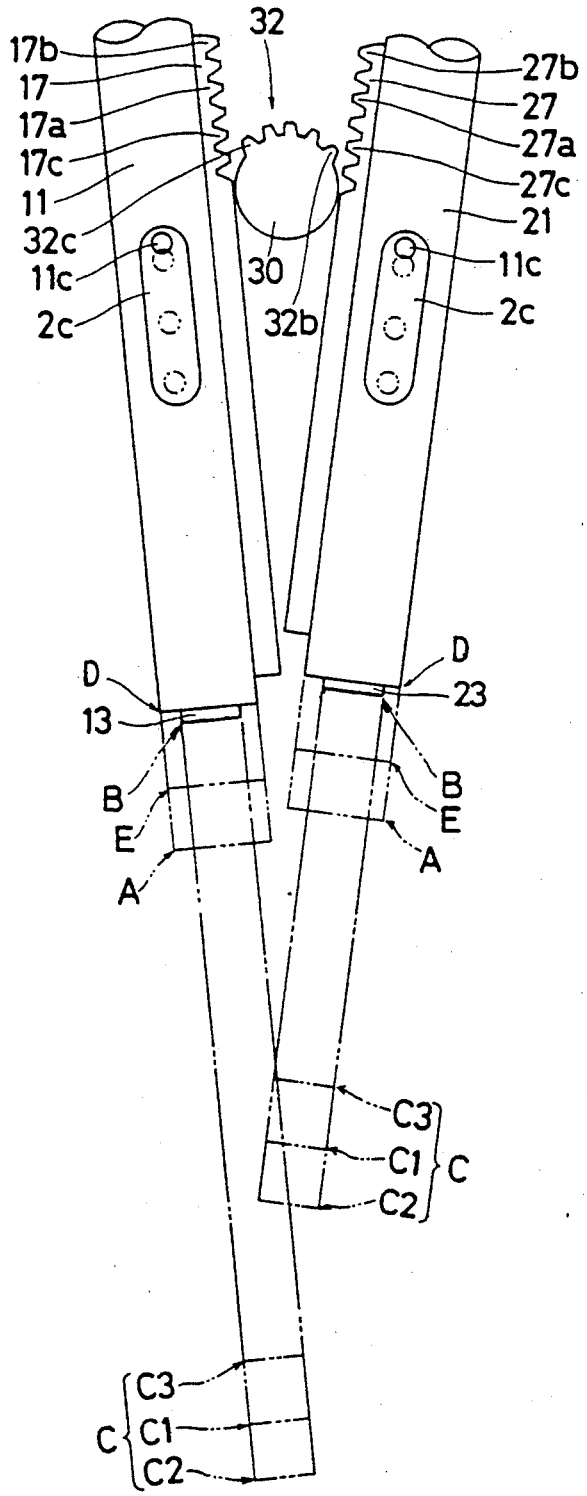
FIG. 4 is a schematic view showing operation of the nozzle mechanism shown in FIG. 1.

The sector gear 32 is out of engagement with either of the racks 17 and 27 when the driving member 30 is at its neutral position as shown in FIG. 4. However, once the driving member 30 is brought into clockwise (counterclockwise) rotation by the motor 31, the sector gear 32 is selectively brought into engagement with the rack 27 (17), with the result that the cylinder 21 (11) is selectively forwarded. The circumferential length of the sector gear 32 defined between the end gear teeth 32*b* and 32*c* corresponds to the length between a fully retracted position D and the fully advanced position A of the nozzle 11 (21).

Figure 5:
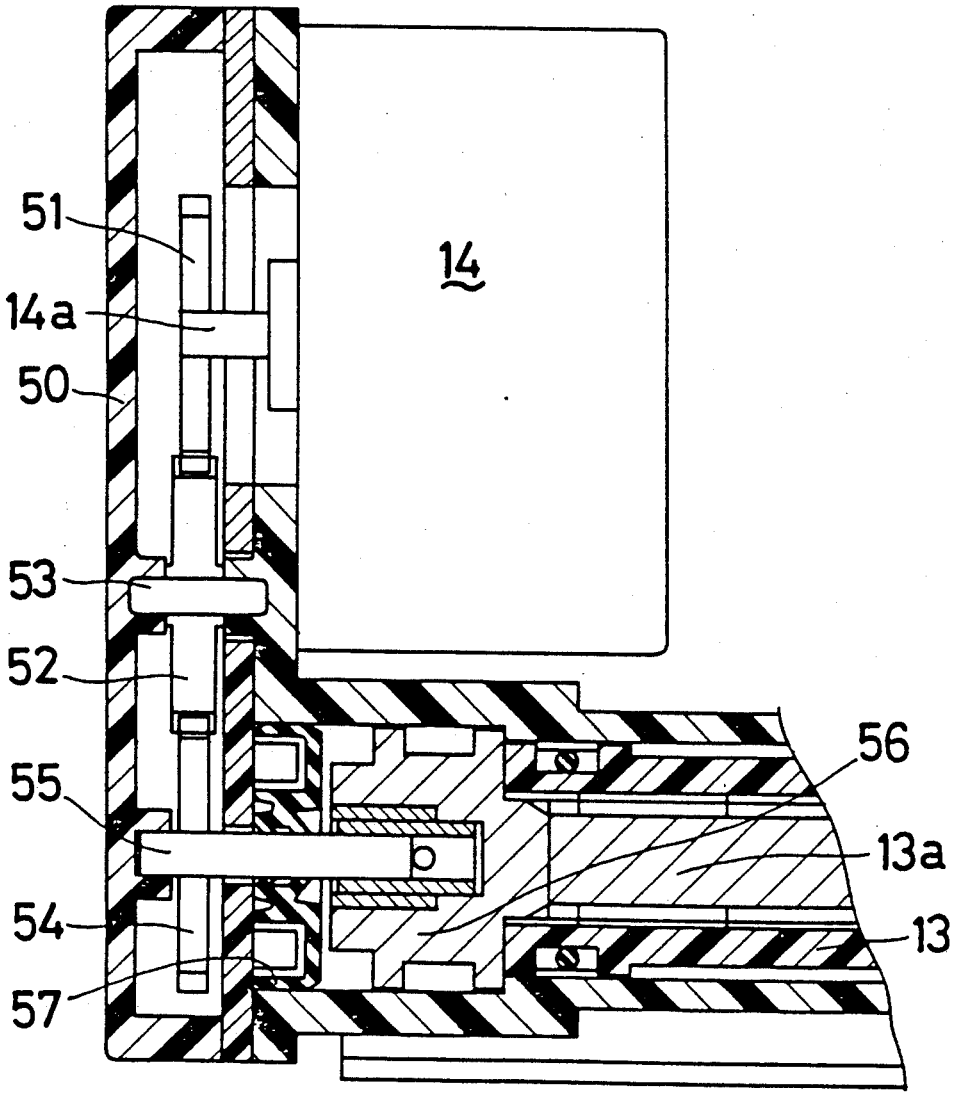
FIG. 5 is a partial sectional view showing how the pipe is moved by a corresponding motor.

In FIG. 5, there is shown a transmission mechanism by which the motor 14 moves the pipe 13. A gear 51 is fixedly mounted on a shaft 14*a* of the motor 14 and is in mesh engagement with a gear 52 which is rotatably supported in a housing 50. The gear 52 is also in mesh engagement with a gear 54 fixedly mounted on a shaft 55 which is rotatable supported by the housing 50 and a sealing member 57 interposed between the housing 50 and the cylinder 11. A member 56 is fixed to the shaft 55 and has an extension 13*a* in the form of a threaded-bar on which the pipe 13 is threadably mounted. Means such as a key and a keyway on the pipe 13 and cylinder prevent the pipe from rotating in the cylinder. When the motor 14 is turned on, rotation is transmitted from the shaft 14*a* to the member 56 via the gear 51, the gear 52, the gear 54 and the shaft 55. Due to unitary rotation of the member 56 and the extension 13*a*, the pipe 13, which is non-rotatably mounted in the cylinder 11, is moved along the extension 13*a* in the frontward or rearward direction based on the rotating direction of the extension 13*a*. It is noted that similar transmission mechanism is provided between the motor 24 and the nozzle 23.

The motor 31 must have sufficient torque to overcome the force of the spring 12 (22). However, it is far more compact than would be a system having separate motors for advancing the cylinders 11 (21), each of which would have to have the same torque as the motor 31, and is more compact than a motor having sufficient torque to advance a single cylinder carrying both pipes.

In operation, when the motor 14 (24) is turned on before washing the bidet or pubic portion (the anus) of the user, the pipe 13 (23) is advanced towards the bowl interior and into position C3 for washing user portions H (K). If, simultaneously, the motor 31 is turned on so as to rotate the driving member 30 in the counter-clockwise (clockwise) direction, as seen in FIG. 4, due to this rotation of the member 30 the sector gear 32 thereof is brought into engagement with the teeth 17*a* (27*a*) of the rack 17 (rack 27), thereby respectively bringing the cylinder 11 (21) and the pipe 13 (23) to a normal set position E and a normal operating position C1. Thereafter the neighborhood of a portion F (I) of the user is washed by water ejected from the hole 16 (26) It is noted that the motor 31 can be turned on before the advance of the pipe 13 (23) or after completion of the advance of the pipe 13 (23)

Under this condition, when the driving member 30 is further rotated in the counter-clockwise (clockwise) direction, in FIG. 4, by turning on the motor 31 the tooth 32*b* (32*c*) of the gear 32 is brought into engagement with a tooth 17*b* (27*b*) of the rack 17 (27) with the result that the cylinder 11 (21) is transferred to its fully advanced position A. Thus, the pipe 13 (23) is positioned at its fully advanced operating portion C2 and water ejected therefrom washes the neighborhood of a portion G (J) of the user. Upon completion of the washing, the motor 14 (24) is turned on in the reverse direction for retracting the pipe 13 (23). Simultaneous with the retracting movement of the pipe 13 (23), the motor 31 is is turned on for rotating the member 30 in the clockwise (counter-clockwise) direction, thereby releasing the engagement of the rack 17 (27) and the sector gear 32 of the member 30. Then, due to the urging force of the spring 12 (22), the cylinder 11 (21) is returned to its fully retracted position B. It is noted that the motor 31 can be turned on before the retracting movement of the pipe 13 (23) or after completion of the retracting movement of the pipe 13 (23).

While the invention has been particularly shown and described in detail with reference to preferred embodiments thereof, it will be understood by those skilled in the art that the foregoing and other change in form and details can be made therein without departing from the spirit and scope of the invention.

What is claimed as new and desired to be secured by letters patent of the United States is:

1. A nozzle mechanism of a sanitary device for selectively washing either the anus or the bidet portion of a user, comprising:

a plate fixedly mounted on a rear end portion of a toilet bowl;

a first cylinder mounted on the plate so as to be movable towards the interior of the toilet bowl;

a first pipe mounted in the first cylinder so as to be movable with the first cylinder in the axial direction thereof;

first driving means for moving the first pipe;

a second cylinder mounted on the plate so as to be movable towards the interior of the toilet bowl and making an angle with respect to the first cylinder;

a second pipe mounted in the second cylinder so as to be movable with the second cylinder in the axial direction thereof;

second driving means for moving the second pipe; and common mechanical driving means selectively movable into engagement with a drive portion of either of said first or second cylinders for selectively and independently driving the first cylinder or the second cylinder towards the interior of the toilet bowl, whereby either of said cylinders is driven by the common driving means, whereby the first and second cylinders may be driven to selectively wash either the anus or the bidet portion of the user.

2. A nozzle mechanism according to claim 1, wherein the drive portion of said first or second cylinders comprises a rack mounted thereon and the common driving means includes a motor and a sector-gear rotatable by the motor, said sector gear being positioned between the cylinders and positioned for mesh engagement with one of said racks of said cylinders upon rotation of said driving means in one direction, and for mesh engagement with the other of said racks of said cylinders upon rotation of said driving means in an opposite direction.

3. A nozzle mechanism according to claim 1 further comprising a first spring means for urging the first cylinder in a retracting direction away from the interior of the toilet bowl and a second spring means for urging the second cylinder in a retracting direction away from the interior of the toilet bowl.

4. A nozzle mechanism according to claim 3, wherein each of the first and second driving means comprises a motor supported for movement with a respective one of said cylinders.

* * * * *